US005097254A

United States Patent [19]

Merrithew

[11] Patent Number: 5,097,254

[45] Date of Patent: Mar. 17, 1992

[54] SWIMMER PROTECTION AND POOL SAFETY WARNING DEVICE

[76] Inventor: Walter F. Merrithew, 27 Blair Street, Fredericton, New Brunswick, Canada, E3B 5X1

[21] Appl. No.: 585,906

[22] Filed: Sep. 21, 1990

[51] Int. Cl.[5] ..... G08B 23/00

[52] U.S. Cl. ..... 340/573; 340/529; 367/910

[58] Field of Search ..... 340/573, 566, 529, 539, 340/614, 626, 665; 367/142, 160, 910

[56] References Cited

U.S. PATENT DOCUMENTS

| | | | |
|---|---|---|---|
| 3,587,038 | 6/1971 | Massa, Jr. | 367/118 |
| 3,686,656 | 8/1972 | Richards | 340/626 X |
| 3,810,146 | 5/1974 | Lieb | 340/573 X |
| 3,867,711 | 2/1975 | Ruscus | 340/566 X |
| 4,635,242 | 1/1987 | Hart | 367/134 |
| 4,820,953 | 4/1989 | Saubolle et al. | 367/134 X |
| 4,932,009 | 6/1990 | Lynch | 340/566 X |

*Primary Examiner*—Glen R. Swann
*Assistant Examiner*—Thomas J. Mullen, Jr.
*Attorney, Agent, or Firm*—Sidney T. Jelly

[57] ABSTRACT

A swimmer protection and pool safety warning device comprises a portable sonic signal generating member worn by a swimmer in a pool, the signal generating member having a switch or similar device which is activated at a predetermined depth. Also included is a timer for detecting immersion at said predetermined depth for a predetermined time. On immersion occurring at the predetermined depth for the predetermined time, a sonic signal is generated, and detected by a receiver mounted in the pool. An alarm signal is generated to operate an alarm device. Calibration of the source signal generating member can be provided.

16 Claims, 3 Drawing Sheets

SWIMMER PROTECTION AND POOL SAFETY WARNING DEVICE

BACKGROUND OF THE INVENTION

1. Field of the Invention

This invention relates to a swimmer protection and pool safety warning device, and particularly to such a device which will result in a warning signal if a swimmer remains below a predetermined depth for more than a predetermined time.

2. Related Art

It can occur that a swimmer, or other person in a pool, as a result of illness, or some form of accident, will sink down into the water. Such an occurrence may not be noted by other persons, including lifeguards, particularly if there are many people in the pool. A person may be under water for a long time before being noticed and it can be too late to save life.

Various devices exist for detecting persons falling off of boats. Such devices generally rely on some form of water actuated detector to cause an alarm to be sounded. Other systems constantly monitor the positions of persons, such as members of the crew of a boat. If someone moves outside a predetermined envelope, then an alarm sounds.

Such devices are not suitable for use by swimmers who can quite safely remain in the water for a long time, and may frequently leave the water and return. Also such persons may dive and go below a particular depth and then rise back up to the surface. It would be most unsatisfactory for any device to result in numerous alarms due to quite normal activities of a person in a pool.

SUMMARY OF THE INVENTION

The present invention provides a swimmer protection and pool safety warning device in which a warning signal is produced if a user remains below a predetermined depth for more than a predetermined time.

Broadly the device of the invention comprises a pressure actuated portable sonic signal generating member for wearing by the swimmer; a sonic receiver and an alarm.

More specifically, the device of the present invention comprises a battery powered pressure actuated sonic signal generating device, with a time delay function. A sonic signal receiver receives any signal from the sonic signal generating device and generates a signal which is received by a further receiver associated with an alarm. Calibrating means can be provided for the sonic signal generating device, and such calibrating means can be self-calibrating.

BRIEF DESCRIPTION OF THE DRAWINGS

The invention will be readily understood by the following description of certain embodiments, by way of example, in conjunction with the accompanying drawings, in which:

FIG. 1 illustrates, in a diagrammatic manner, the present invention. In a pool 10, a swimmer 11 has a pressure actuated sonic signal generating device 12 attached to the wrist. On a wall 13 of the pool 10 is attached a sonic receiver 14. Sonic receiver 14, on receipt of a signal from the generating device 12, generates an output signal which passes along conductor 15 to a further sensor and alarm generator 16.

The pressure in a pool depends upon the depth and the device 12 has a pressure sensor which can have an active condition at a pressure corresponding to a predetermined depth. If a swimmer is at this depth, or below, then the sensor is actuated. To avoid false alarms as would occur during diving, or swimming under water, a time delay is provided in the device 12 so that only immersion at or below the predetermined depth for at least a predetermined time will permit actuation of a sonic generator in the device 12.

On actuation of the sonic generator, the sonic signal is detected by the sonic receiver 14, on the pool wall. This in turn produces a signal which is fed along the conductor 15 to the alarm generator 16.

Figure 1:
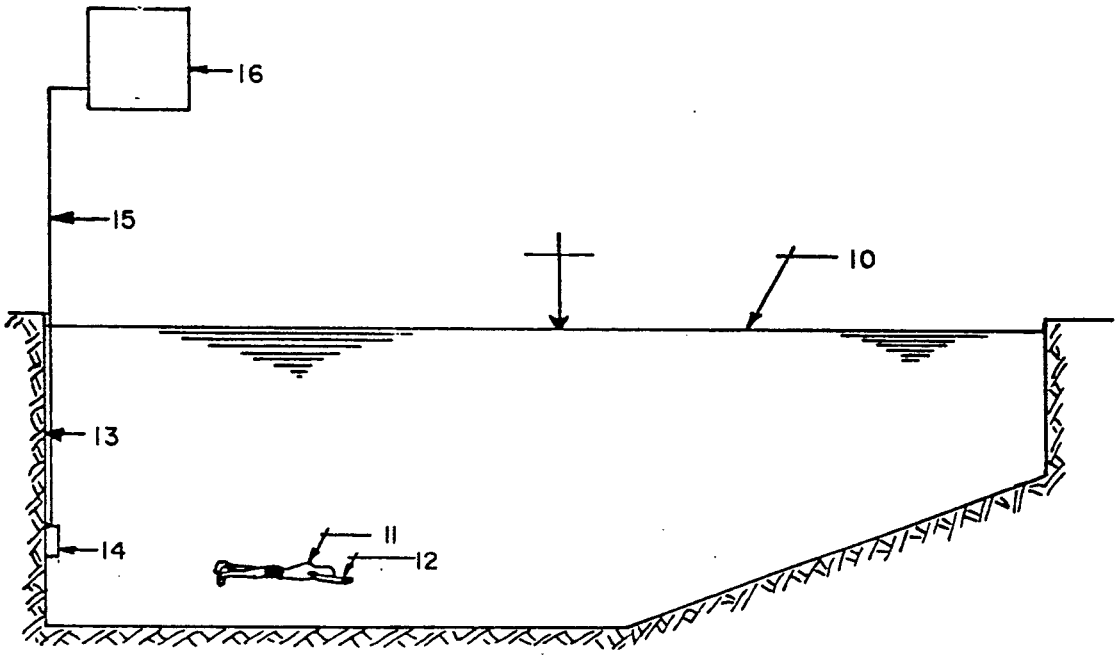
FIG. 1 is a diagrammatic vertical cross-section through a pool illustrating application of the invention.
Figure 2:
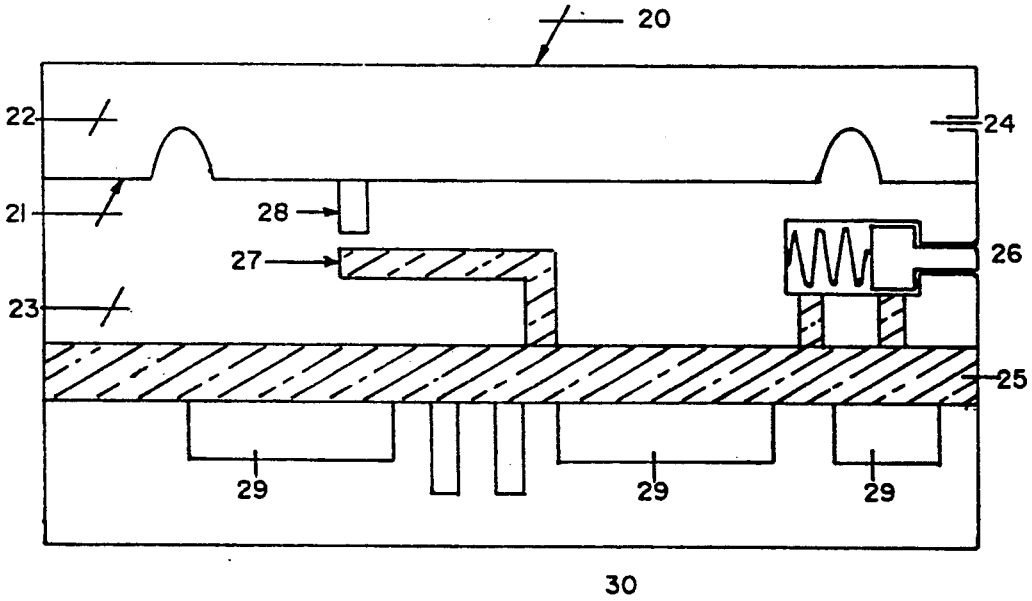
FIG. 2 diagrammatically illustrates one form of portable pressure sensor unit.

FIG. 2 illustrates in a diagrammatic form a portable pressure sensing device, with a sonic generator. The device is mounted in a case 20, for example of stainless steel. The case is divided into two compartments by a diaphragm 21, giving a water side 22, and an air side 23. The water side is open to the exterior via inlet 24. A circuit board 25 supports an air inlet valve 26, and one side or contact 27 of a switch. The other side, or contact 28 is mounted on the diaphragm 21. Various electronic components 29 are mounted on the circuit board. A piezo bender 30, similar to that used in alarm wrist-watches for example, is mounted on the casing, connected electrically to the circuitry on the circuit board.

Figure 3:
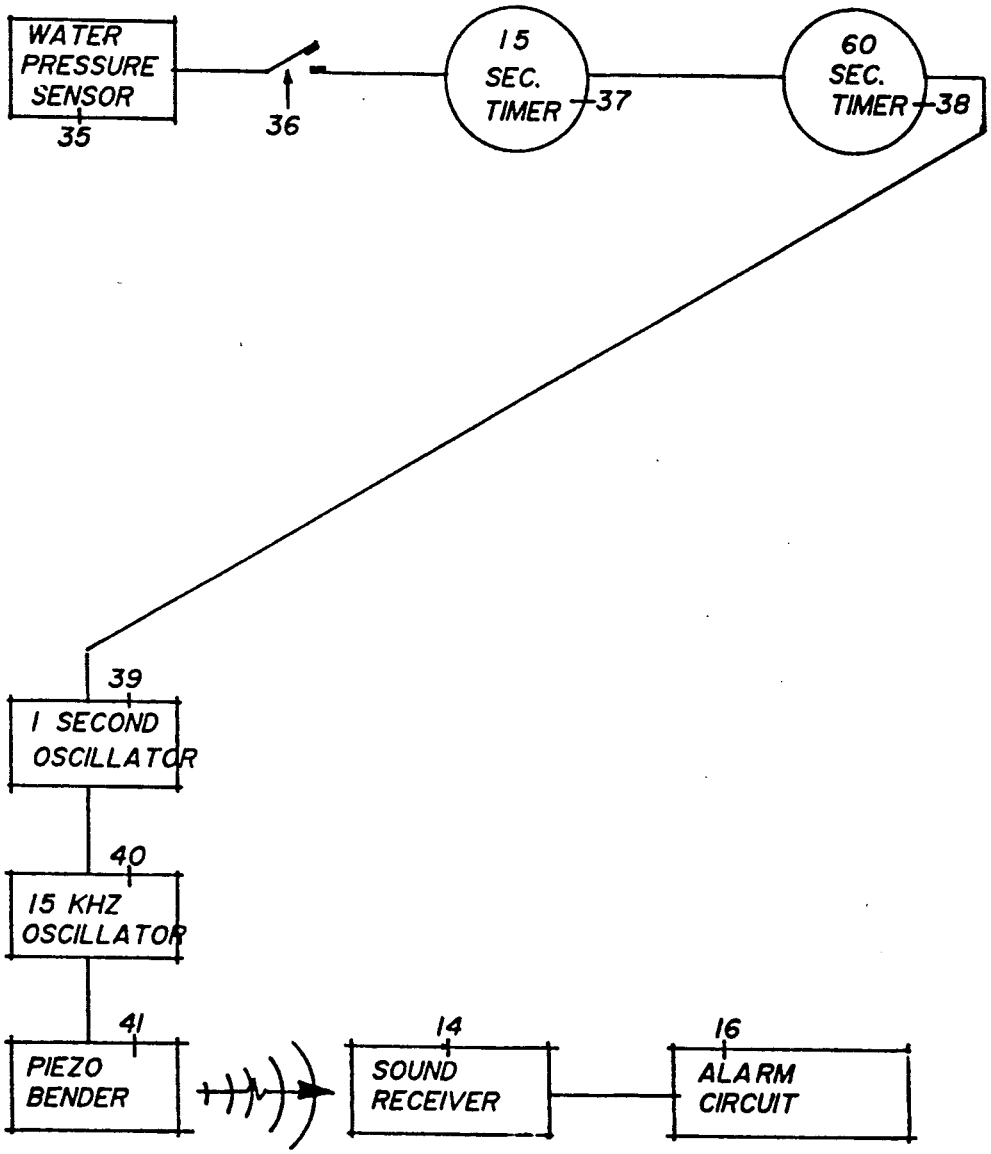
FIG. 3 is a block diagram of one form of alarm device, or system.

FIG. 3 illustrates in block form one form of circuitry. The pressure sensor 35 represents the casing with the diaphragm dividing into sides. Actuation of the sensor, by an increase of pressure in the water side closes switch 36—composed of contacts 27 and 28 of FIG. 2. Closure of the switch starts an electronic timer 37. If the swimmer rises to the surface, then the switch 36 will open and the timer resets. However if the swimmer stays down for the predetermined time, example 15 seconds then a second timer 38 generates a series of pulses via oscillator 39 to produce a series of 15 KHz pulses via a 15 KHz oscillator 40, to produce "beeps" from the piezo "bender" 41. The beeps can be of some suitable length, for example 1 second for a 1 second oscillator at 39. The beeps can continue for a desired time, for example 60 seconds using a 60 second timer at 38. This would provide ample opportunity for the receiver 14 to detect the characteristic frequency and timing, and thus actuate the warning device. The circuitry can be provided by low power timer chips and inexpensive associated components. Battery power can be by lithium cell with a lifetime of several years. Power consumption would be negligible except when beeping. Battery condition can readily be tested by immersing the sensor at the predetermined depth for the predetermined time.

The receiver 14 can be mounted anywhere in the pool, as sound travels very efficiently in water. It could be clamped to a pool ladder for example. It would normally be battery powered and several small, for example, D size, cells would provide ample power for a year. A test circuit could be included to indicate low battery condition. The conductor 15 connects the receiver 14 of the alarm unit 16, which can be battery or AC powered. If powered by a normal AC power supply, isolation would be used, for example, opto-isolation, to prevent any possibility of electric shock in the pool.

As a test, a beeper of the type described was set to beep continuously. An underwater swimmer could detect the sound easily in a pool thirty feet long. Depth and orientation of the beeper made no difference. The sound could sometimes be heard outside the water. Thus sonic coupling between the sensor 12 and receiver 14 is very efficient.

There are various errors, or variations, associated with the measurement of depth but these have been found to be within acceptable limits. Thus there will be some variation due the actual altitude of the pond. This approximates to dB=0.1 dH, where dB is the deviation in air pressure (millibars) and dH is the increase in altitude above sea level (suction), referenced to 1013 mbar at sea level. However this variation can usually be ignored as it is possible to measure relative, or gauge pressure.

If gauge pressure is measured by entrapping air in a chamber on one side of a diaphragm and applying water to the other side, then the pressure measurement will be affected by changes in the temperature of the air, as the pressure of the trapped air, which forms the reference for the measurement of the water pressure, will vary in proportion to its absolute temperature. However this would not be a serious problem as a pool would remain at nearly the same temperature at the considered depth. Arrangements can be made for the air to be trapped under controlled conditions approximating those of the water. Any temperature variation arising as the swimmer leaves the pool will be rapidly removed when the swimmer re-enters the water.

Changes in air pressure, during use by a swimmer, also affect the sensor. However such pressure changes, during a period of use, will be relatively small and would cause no problems. Other pressure effects, due to heating/ventilation/air conditioning in enclosed pools, for example are minimal.

Gauge errors also occur. A typical gauge error is ±5 percent and would be acceptable.

It has been found that, provided control over temperature variation is provided, the total variation is the order of ±6 inches for a depth of four feet. Various methods of controlling the effect of temperature variations can be provided. One is to store the sensors in a box which is maintained at the same temperature as the water temperature at the predetermined depth, with air entrapped at this temperature. Another method is to store the sensors in a container at the predetermined depth, and say once a day i.e., in the morning, air is entrapped while still at the particular temperature. Other methods can be provided.

The air is entrapped in the air side 23 of the sensor via the valve 26. This valve is arranged to be actuated by strong pressure with a special tool, used by the pool management, as necessary.

In many instances the device of the invention will be used under conditions where the atmospheric temperature will be fairly close to the water temperature and at a fairly constant difference. Such would be the case when used in indoor pools. In such circumstances, temperature variations would become of little or no consequence and could be ignored.

The pressure sensor unit would be a "bought out" ready made unit, having a preset pressure differential to suit requirements. Depending on the pool, and particularly the shallowest depth, the predetermined depth for operation would be selected to suit. Normally the predetermined depth would be slightly less than the depth of the shallowest part of the pool. This would allow for some variation in actual actuating pressure due to temperature differences, manufacturing limits, and other variables. Also, an allowance in the preset pressure differences can be made to cater for a certain difference between air temperature and water temperature.

If desired, a self-calibration feature can be incorporated in the pressure sensor unit. To detect the position of the swimmer below the surface, the detector must compare the pressure under water to the atmospheric pressure above the water. If the atmospheric pressure has changed, the device must be able to update the value it uses for atmospheric pressure. It does this in the following way:

The detector contains a sensor which measures absolute pressure in the air or water surrounding the detector. The value of this pressure at any given moment will be referred to as the "current pressure". The detector is turned on automatically whenever it is strapped onto the wrist. When the detector is turned on, a voltage proportional to current pressure is automatically sampled, then stored electronically. This stored value will be referred to as the "stored pressure".

The stored pressure and the current pressure are continually compared. The stored pressure is updated automatically with a new value proportional to the current pressure if the pressure sensor indicates that the current pressure is less than the stored pressure. This ensures that the stored pressure is updated if the atmospheric pressure happens to decrease during the swim. However, the updating system also performs another function. The storage method is such that the stored value for pressure always changes slowly in a direction such that the stored pressure appears to increase. Over a period of 30 minutes (nominally) the stored pressure appears to increase by the equivalent of approximately 6 inches of water. On the assumption that the swimmer will have the detector within 6 inches of the surface at least once every 30 minutes, this slow change in value of the stored pressure will ensure that the stored value gets updated at least every 30 minutes (because the current pressure will appear to be less than the stored pressure).

The above system results in the following measurement characteristics:

Normally, the first value stored will be the atmospheric pressure because the swimmer will turn the device on before entering the water.

If for some reason the device is turned on only after the swimmer has entered the water, the stored pressure will be updated as soon as the device moves toward the surface, and will continue to update every time it gets closer to the surface.

If atmospheric pressure decreases or remains the same, the stored pressure will be updated to a new value whenever the swimmer's arm comes out of the water.

If the swimmer's arm does not come out of the water during a 30 minute period, and the atmospheric pressure is decreasing or remains the same, the stored pressure will be updated within that period to a value to within 6 inches water column above the proper atmospheric pressure (an acceptable error).

If the atmospheric pressure is increasing, the change rate of the stored pressure (always in the direction of increasing pressure) will ensure that the stored pressure overtakes the atmospheric pressure, and an update will occur. Normally, atmospheric pressure changes at a rate below 2 mbar/hour, which is much less than the 6 inches w.c. per 30 minutes for the stored pressure. Under these assumptions, the maximum error in depth calculation would be 0.4 inches before the update occurs. The update will of course occur only at depths of less than 6 inches.

Figure 4:
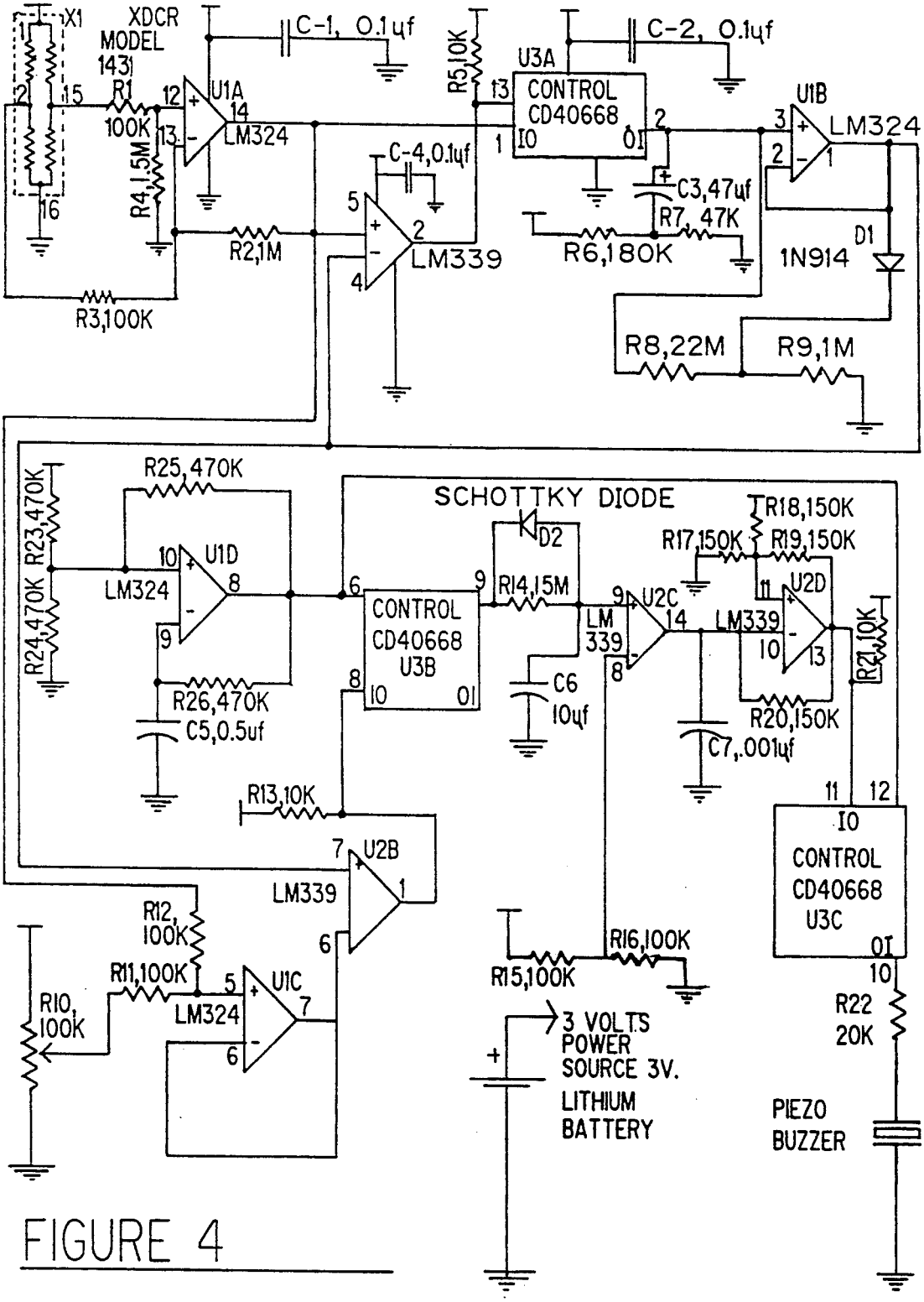
FIG. 4 is one circuit for a self-calibrating means for the sonic signal generator.

FIG. 4 shows one circuit for providing a self-calibrating feature. A silicon absolute pressure sensor X1 (IC Sensors 1431) is connected to an operational amplifier (op amp) U1A, which amplifies and level-shifts the sensor voltage. This voltage is a measure of the "current pressure" described in the section on auto-calibration.

Note that in this embodiment, the voltage decreases with increasing pressure. At 14.7 psi, the voltage is approximately 1.749 VDC: as pressure increases from that value, the voltage linearly decreases to approximately 1.717 VDC at 4 feet. Capacitor C3 stores a sample of the "current pressure" voltage until it is updated by closure of analog switch U3A. The capacitor voltage is associated with the "stored pressure". Note that as the capacitor voltage bleeds off, or decreases with time, the decreasing voltage will correspond to an increasing pressure, which fits the design plan. Op amp U1B, connected as a voltage follower, relays the capacitor voltage to comparator U2A, whose other input is connected to the "current pressure" voltage. The comparator closes analog switch U3A whenever the stored pressure exceeds the current pressure. Components R6, R7, R8, R9 and D1 associated with the voltage follower op amp U1B are designed to compensate for offset currents at the input of the op amp and to ensure that the stored pressure always increases with time. This is accomplished by discharging the capacitor through resistor R8 into a voltage which is determined by D1 and R9 to be a fixed amount below the U1B output voltage, and by setting the voltage at the junction of R6 and R7 to be slightly below the lowest voltage to be stored.

Op amp U1C is arranged to level-shift the "current pressure" voltage by the equivalent of 4 feet water column. This value is compared with the "stored pressure" voltage at the inputs to comparator U2B. The output of U2B goes high if the drown detector is 4 feet or more underwater. The output of comparator U2B is fed through analog switch U3B and resistor R14 to capacitor C6 every 0.5 seconds. The 0.5 second sampling time is determined by op amp U1D, which is designed to generate square waves with a period of approximately 0.5 seconds. A "high" output from a comparator will charge the capacitor through resistor R14 for the amount of time that analog switch U3B stays on (about 0.25 seconds). If the comparator output is "low" then diode D2 discharges the capacitor. The capacitor circuit is designed to reach a level sufficient to turn on comparator U2C if the capacitor has received successive charging pulses for 15 seconds. When comparator U2C turns on, square waves of a frequency appropriate for driving the piezo buzzer P1 (about 10 KHz) are generated by U2D and associated components, and passed through analog switch U3C, which gates the piezo bender signal on and off every 0.5 seconds. This is a signal sufficiently distinctive to be uniquely detected by a separate alarm generator circuit.

All of the components selected for this circuit are designed to be powered from a 3 volt lithium cell. All are available in surface amount form except for C3.

An example of a pressure sensor as used in the circuit in FIG. 4 is the Model 1431 OEM Pressure Sensor, by IC sensors, of Milipitas, Calif., which is a solid-state piezo resistive pressure sensor packaged in a surface mount configuration. It has small size, light weight and low cost. It comprises an absolute pressure sensing chip attached to a surface mountable substrate. The chip contains an integral vacuum reference.

The pressure sensor unit, with the switch, timers and oscillators are mounted, with a battery, in a case similar to a watch case and attached to the wrist of a swimmer by a wrist band. Attachment can, of course, be to some other part of a swimmer, for example at an ankle, or by attachment to some part of the swimmer's clothing.

The swimmer's units would be issued by an attendant when a swimmer enters the pool enclosure, and returned on leaving. It is not necessary to provide different frequencies for each of the units as it is only necessary that a warning be produced if any swimmer exceeds the depth and time limits.

What is claimed is:

1. A swimmer protection and pool safety warning device comprising:

a pressure actuated portable sonic signal generating member adapted to be worn by a swimmer, said signal generator including a time delay of a predetermined period, and a switching component actuated at a predetermined depth;

a sonic receiver for receiving sonic signals from said sonic signal generating member, and including means for generating a signal on receipt of said sonic signals;

an alarm unit and means for transmitting said signals from said sonic receiver to the alarm unit to produce an alarm signal.

2. A device as claimed in claim 1, said sonic signal generator including a first timer for providing said time delay of a predetermined period, and a second timer for causing signals to be generated for a set period.

3. A device as claimed in claim 2, said second timer controlling the generation of pulses from an oscillator, said pulses being applied to a sonic generator.

4. A device as claimed in claim 3, said second timer controlling the generation of pulses from a pulse oscillator having a present time setting, said pulse oscillator controlling the generation of high frequency pulses from a further oscillator, said high frequency pulses being applied to a piezo type sonic generator.

5. A device as claimed in claim 1, said portable sonic signal generating member contained in a housing adapted to be attached to a swimmer.

6. A device as claimed in claim 5, said housing including means for attaching to a wrist of a swimmer.

7. A device as claimed in claim 1, said sonic receiver adapted for mounting in a swimming pool.

8. A device as claimed in claim 7, said sonic receiver adapted for mounting on the wall of the swimming pool.

9. A device as claimed in claim 1, said switching component comprising a diaphragm extending across a chamber, trapped air on one side of said diaphragm, the other side of said diaphragm open to admit water from a pool, a first contact on said diaphragm and a second contact spaced from said first contact, whereby on increase of pressure on said other side to a predetermined value corresponding to said predetermined depth, said first contact is moved into contact with said second contact.

10. A device as claimed in claim 9, including valve means for admitting air to said one side of said diaphragm.

11. A device as claimed in claim 1, including means for calibrating the sonic signal generating member.

12. A device as claimed in claim 11, said means for calibrating comprising a self-calibrating means.

13. A device as claimed in claim 12, said switching component comprising an analogue switch.

14. A method of swimmer protection and pool safety warning, comprising:

providing a pressure actuated portable sonic signal generating member for wearing by a swimmer in a pool detecting a pressure increase at said portable sonic signal generating member corresponding to a predetermined depth and actuating a switching member at said pressure increase; actuating a timer by said actuating of said switching member and detecting a predetermined time period at said predetermined depth; producing a sonic signal at the end of said predetermined time period; receiving said sonic signals at a sonic signal receiver in said pool; generating an alarm signal at said sonic receiver and transmitting said alarm signal to an alarm device.

15. The method of claim 14, including calibrating said sonic signal generating member.

16. The method of claim 15, the step of calibrating said sonic signal generating member carried out by self-calibrating means.

* * * * *